United States Patent [19]

Young

[11] Patent Number: 5,058,808

[45] Date of Patent: Oct. 22, 1991

[54] BURNER NOZZLE

[75] Inventor: Timothy M. Young, Coppell, Tex.

[73] Assignee: Halliburton Company, Duncan, Okla.

[21] Appl. No.: 573,094

[22] Filed: Aug. 24, 1990

[51] Int. Cl.[5] ..... B05B 1/34; B05B 1/30

[52] U.S. Cl. ..... 239/464; 239/487; 239/533.1

[58] Field of Search ..... 239/477, 474, 487–489, 239/494, 464

[56] References Cited

U.S. PATENT DOCUMENTS

| | | | |
|---|---|---|---|
| 985,505 | 2/1911 | Brinks . | |
| 1,060,164 | 4/1913 | Coen | 239/483 X |
| 1,530,510 | 3/1925 | Morse . | |
| 2,179,139 | 11/1939 | Strosk | 299/120 |
| 2,325,495 | 7/1943 | Ferguson | 299/143 |
| 2,636,778 | 4/1953 | Michelsen | 299/120 |
| 2,674,493 | 4/1954 | Raskin et al. | 239/483 |
| 2,762,656 | 9/1956 | Fraser | 299/120 |
| 2,801,881 | 8/1957 | Campbell | 239/464 |
| 3,026,048 | 3/1962 | Gascoigne et al. | 239/424 |
| 3,164,200 | 1/1965 | Reed | 158/11 |
| 3,228,612 | 1/1966 | Graham et al. | 239/132.3 |
| 3,347,463 | 10/1967 | Baker | 239/489 X |
| 3,394,888 | 7/1968 | Dasse et al. | 239/424 |
| 3,460,911 | 8/1969 | Krejci et al. | 23/259.5 |
| 3,668,869 | 6/1972 | De Corso et al. | 60/39.74 R |
| 3,827,632 | 8/1974 | Rymarchyk et al. | 239/132.3 |
| 3,838,821 | 10/1974 | Burlyn | 239/450 X |
| 4,011,995 | 3/1977 | Krause, Jr. | 239/404 |
| 4,427,367 | 1/1984 | Yagisawa | 431/354 |
| 4,664,619 | 5/1987 | Johnson et al. | 431/154 |

FOREIGN PATENT DOCUMENTS

| | | |
|---|---|---|
| 12808 | 4/1914 | German Democratic Rep. . |
| 648483 | 8/1937 | German Democratic Rep. . |
| 566133 | 12/1944 | United Kingdom . |

OTHER PUBLICATIONS

Gas Turbine Combustion, pp. 413–431.

*Primary Examiner*—Andres Kashnikow
*Assistant Examiner*—Kevin P. Weldon
*Attorney, Agent, or Firm*—C. Dean Domingue; Neal R. Kennedy

[57] ABSTRACT

A burner nozzle for petroleum products. The burner nozzle comprises a housing portion with a nozzle assembly disposed therein. In the nozzle assembly are an outer disc and an inner disc disposed in the outer disc. Helical ramps on the outer and inner discs define gaps or fluid flow orifices therebetween. A spring biases the ramp on the inner disc toward the ramp on the outer disc. Fluid pressure in the tube portion forces the ramps apart to increase the orifice size to maintain a relatively high fluid flow velocity through a wide flow rate range. Fluid is discharged from the orifices in a spiraling pattern and impinges a conical inner surface of a swirl chamber from which the fluid is discharged from the burner nozzle.

16 Claims, 2 Drawing Sheets

BURNER NOZZLE

BACKGROUND OF THE INVENTION

1. Field Of The Invention

This invention relates to burner nozzles for burning petroleum products during well testing, and more particularly, to a burner nozzle having an adjustable orifice for flowing fluid into a swirl chamber.

2. Description Of The Prior Art

Burner nozzles in which petroleum products are burned, particularly to dispose of the products of oil well testing, are well known. The function of such nozzles is to atomize the petroleum products to facilitate burning. The atomization process occurs as the fluid is discharged from the nozzles and dispersed as tiny droplets. The smaller the droplet size, the better the atomization and the more complete the combustion process. This results in less fallout of unburned petroleum products. Finer fluid droplet size improves combustion by allowing adequate air to surround the droplet to complete the combustion process.

In many conventional burner nozzles, a substantially cylindrical swirl chamber is used having fixed orifice inlet ports. The inlet ports are perpendicular to the central longitudinal axis of the nozzle and are offset from the center line thereof. This geometry creates a swirl which produces a substantially conical fluid pattern as the fluid is discharged from the cylindrical swirl chamber. A burner nozzle of this type is disclosed in co-pending U. S. Pat. Application Ser. No. 07/350,105, assigned to the assignee of the present invention.

The orientation of the ports in these swirl chambers is such that each port jets into the one adjacent to it within the swirl chamber, and the fluid stream splits. One side of the fluid stream continues through the swirl chamber, and the other side is directed to the rear wall or back plate of the swirl chamber where erosion can occur, resulting in a loss of fluid energy and velocity.

A burner nozzle which addresses this erosion problem is disclosed in co-pending U.S. Pat. Application Ser. No. 07/431,050, also assigned to the assignee of the present invention. In the burner nozzle of Application Ser. No. 7/431,050, the swirl chamber has inlet ports which are disposed at an acute angle with respect to the longitudinal axis of the nozzle. This provides a gradual fluid entrance directed forward which reduces erosion in the rear wall or back plate of the swirl chamber and also reduces erosion in the nozzle portion of the conical swirl chamber. This design also has the advantage of allowing foreign matter and other debris to pass through the ports more easily than previous designs where the ports were perpendicular to the central axis. However, even with this improved swirl chamber configuration, the size of the inlet ports are fixed.

The quality of fluid atomization depends significantly on the velocity of the fluid into and out of the swirl chamber. The higher the fluid velocity, the smaller the fluid droplet size as the fluid is discharged. The velocity of fluid in nozzles with fixed orifice inlet portions depends on the fluid flow rate and number and inlet area of the orifices. Therefore, poor atomization at low flow rates is usually the result in order for good atomization to be obtained at higher flow rates.

When a well test is initiated, the fluid flow rate is unknown, and once initiated, the test may not be stopped easily to change the orifice size or number of nozzles. Inadequate orifice area may cause a back pressure upstream sufficient to require aborting the test. Excessive orifice area results in low swirl chamber velocity with the corresponding poor atomization and incomplete combustion. Since fluid flow rates typically vary during well tests fixed orifice inlet ports in swirl chambers present difficulties.

The present invention solves this problem by providing an adjustable orifice to admit fluid into the swirl chamber. The orifice size increases as the fluid pressure due to higher flow rates increases. Thus, the orifice size is determined by the flow rate, and the velocity of fluid in the swirl chamber remains high throughout a wide flow range so that good atomization and more complete combustion are maintained.

SUMMARY OF THE INVENTION

The petroleum burner nozzle or burner apparatus of the present invention comprises conduit means for connecting to a fluid source and a nozzle attached to an end of the conduit means and defining a fluid stream orifice therein in communication with the conduit means. The orifice is variable in size in response to fluid pressure in the conduit means. The nozzle comprises a swirl chamber having a conical inner surface for directing a fluid stream discharged from the orifice.

The nozzle also preferably comprises an outer portion or disc element defining a first ramped surface thereon and an inner portion or disc element defining a second ramped surface thereon adjacent to the first ramped surface. The orifice is defined between the first and second ramped surfaces. Preferably, there are a plurality of pairs of first and second ramped surfaces angularly spaced around a central axis of the apparatus. The ramped surfaces are preferably substantially helical. Stated in another way, it may be said that the ramped surfaces are disposed at a substantially constant acute angle with respect to the longitudinal axis.

The apparatus may also comprise biasing means for relatively biasing the first and second ramped surfaces toward one another. In the preferred embodiment, the biasing means is characterized by a compression spring. A fastening means is provided for fastening the biasing means to the inner portion of the nozzle. The fastening means comprises adjusting means for manually adjusting an initial force exerted by the biasing means.

The apparatus also comprises means for limiting a maximum size of the orifice. In the preferred embodiment, this is characterized by contact of the inner portion of the nozzle with the conical inner surface of the swirl chamber.

The apparatus may also comprise sealing means for sealing between the nozzle and the conduit means. Preferably, the sealing means comprises both a metal-to-metal seal and an elastomeric member.

An important object of the invention is to provide a petroleum burner apparatus having a variably sized fluid flow orifice therein.

Another object of the invention is to provide a burner nozzle having an orifice which varies in size in response to fluid pressure.

A further object of the invention is to provide a burner nozzle having a fluid orifice defined by a gap between a pair of ramped or helical surfaces.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
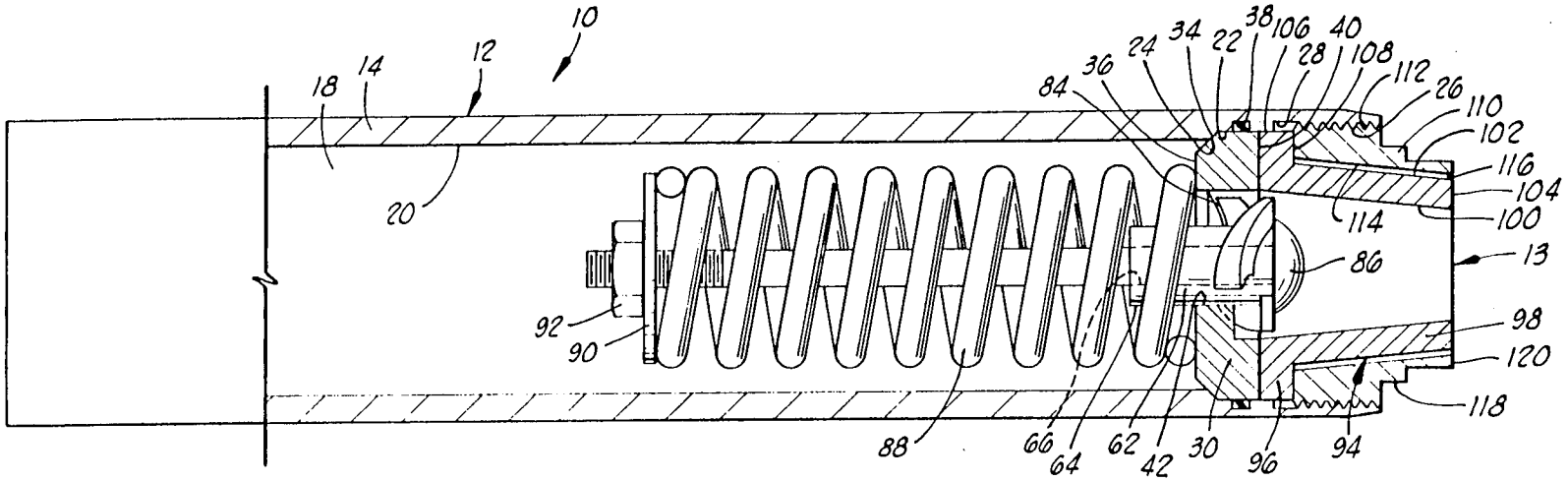
FIG. 1 is a longitudinal cross section of the burner nozzle of the present invention shown in an initial position.
Figure 2:
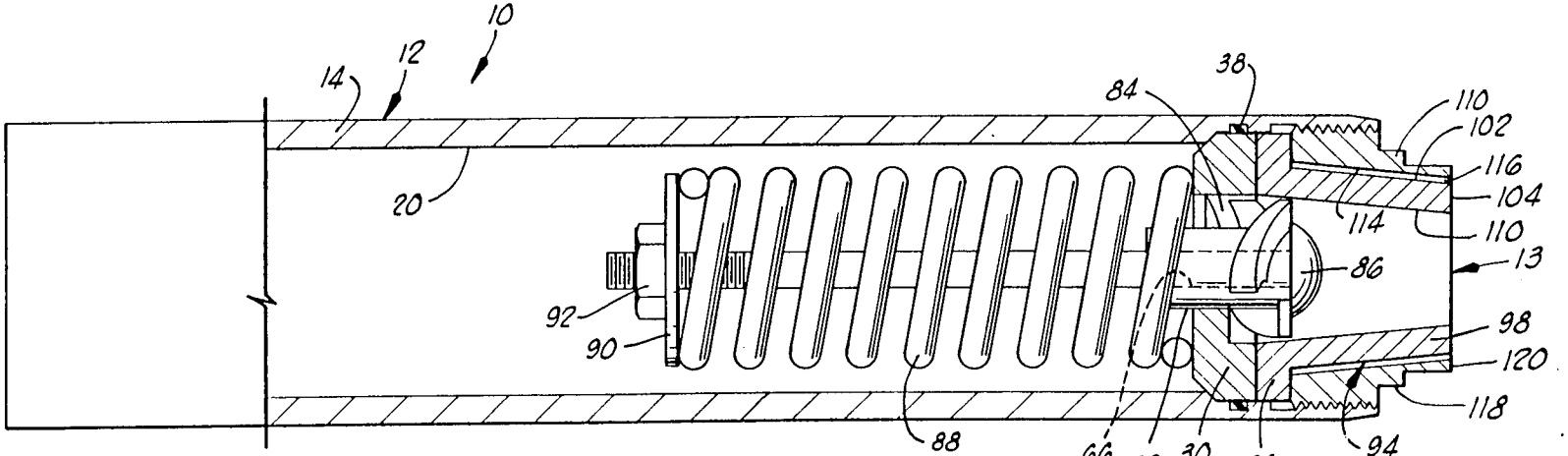
FIG. 2 shows a longitudinal cross section of the burner nozzle in a further open flow position.

Referring now to the drawings, and more particularly to FIGS. 1 and 2, the burner nozzle of the present invention is shown and generally designated by the numeral 10. Burner nozzle 10 generally comprises a fluid conduit means 12, for connecting to a petroleum source (not shown) of a kind known in the art, and a nozzle assembly 13. For the purposes of discussion herein, an outer or front direction with respect to burner nozzle 10 is toward the right in FIGS. 1 and 2, and an inner or rear direction with respect to the burner nozzle is to the left in FIGS. 1 and 2. Burner nozzle 10 may be positioned within an air jacket means (not shown), such as that disclosed in co-pending U.S. Pat. Application Ser. No. 07/431,050.

Conduit means 12 comprises a housing portion 14 adapted for connection to the petroleum source. Housing portion 14 defines one or more housing openings 18 therein. Each housing opening 18 preferably includes a first bore 20 and a slightly larger second bore 22, An annular, radially inwardly facing chamfered surface or shoulder 24 extends between first and second bores 20 and 22. Housing portion 14 may take a variety of forms, such as a tubular member having a singular housing opening 18 therein or a more complex housing having a plurality of housing openings 18.

The outer end of each housing opening 18 of housing portion 14 has a threaded surface 26 therein. A counterbore 28 may separate threaded surface 26 and second bore 22.

Nozzle assembly 13 is disposed in housing opening 18 of housing portion 14 and comprises an outer or first disc 30 also referred to as outer portion or nozzle element 30. Outer disc 30 has an outside diameter 32 adapted to fit closely within second bore 22 of housing portion 14. An annular, radially outwardly facing chamfered surface or shoulder 34 extends between outside diameter 32 and rear or inner face 36 of outer disc 30. Chamfered surface 34 is adapted for metal-to-metal, sealing contact with chamfered surface 24 in housing portion 14.

An elastomeric sealing means, comprising an elastomeric member, such as 0-ring 38, provides sealing engagement between outside diameter 32 of outer disc 30 and second bore 22 of housing portion 14. Thus, a sealing means including both metal-to-metal sealing and elastomeric sealing is provided between outer disc 30 of nozzle assembly 13 and housing portion 14.

Figure 3:
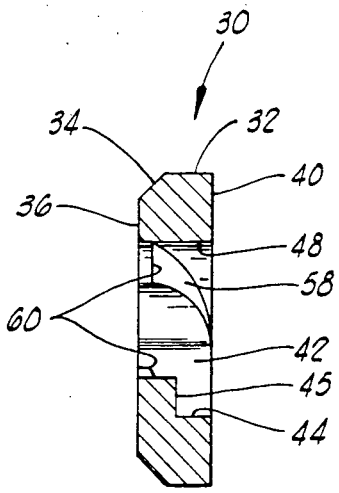
FIG. 3 is a vertical cross section of an outer disc in the burner nozzle taken along line 3—3 in FIG. 4.
Figure 4:
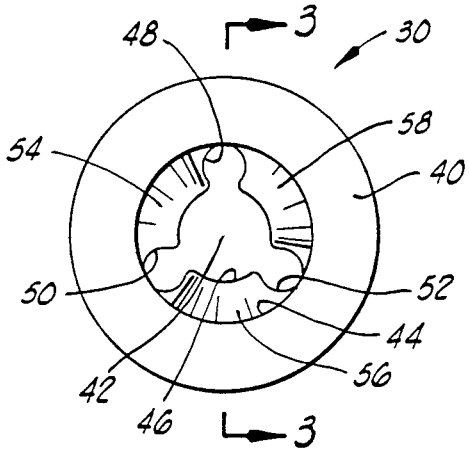
FIG. 4 is a discharge or outer end elevational view of the outer disc.

Referring now to FIGS. 3 and 4, additional details of outer disc 30 will be discussed. Substantially parallel to rear face 36 is a front or outer face 40. Extending through outer disc 30 between front face 40 and rear face 36 is a complex central opening 42.

Central opening 42 includes a shallow first bore 44 having an inner edge 45 and an interrupted second bore 46. A plurality of notches, such as the three notches 48, 50 and 52 illustrated, extend radially outwardly from second bore 46 to first bore 48. Although three notches 48, 50 and 52 have been shown, it is not intended that the invention be limited to this particular number.

A spiraling ramp 54 extends axially inwardly from notch 48 to notch 50. Preferably, ramp 54 is helical. It will be seen that inner edge 45 of first bore 44 also forms the axially outer edge of ramp 48. A similar ramp 56 extends axially inwardly from notch 50 to notch 52, and a ramp 58 extends axially inwardly from notch 52 to notch 48. Each of ramps 54, 56 and 58 has a bottom edge 60 such as illustrated for ramps 56 and 58 in FIG. 3. Ramps 54, 56 and 58 may be referred to as first ramps.

Figure 5:
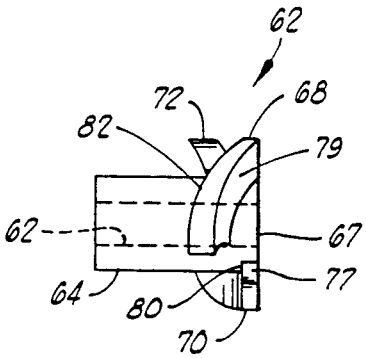
FIG. 5 is a side elevational view of an inner disc used in the present invention.
Figure 6:
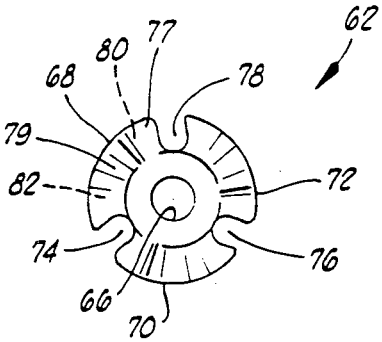
FIG. 6 shows a discharge or outer end elevation of the inner disc.

Referring again to FIGS. 1 and 2, nozzle assembly 13 also comprises an inner or second disc or valve 62 which is disposed in central opening 42 of outer disc 30. Inner disc 62 may also be referred to as inner portion or nozzle element 62. Referring now to FIGS. 5 and 6, the details of inner disc 62 will be discussed.

Inner disc 62 has a substantially cylindrical central portion 64 which has an outside diameter adapted for close, spaced relationship with second bore 46 in outer disc 30. Central portion 64 defines a central bore 66 therethrough and has an outer end 67.

Extending radially outwardly from central portion 64 are a plurality of lugs or lobes, such as lugs 68, 70 and 72. It will be seen that a notch 74 is thus defined between lugs and 70. Similarly, a notch 76 is defined between lugs 70 and 72, and another notch 78 is defined between lugs 72 and 68.

Lugs 68, 70 and 72 each comprise a straight portion 77 with a curvilinear portion 79 extending inwardly therefrom. Straight portion 77 has a substantially flat rearwardly facing surface or face 80, and curvilinear portion 79 forms a rearwardly facing spiralling ramp 82, also referred to as second ramp 82. Preferably, ramp 82 is helical and is curved substantially the same as any of first ramps 54, 56 and 58 in outer disc 30. Also, preferably lobes 68, 70 and 72 are substantially identical.

Figure 7:
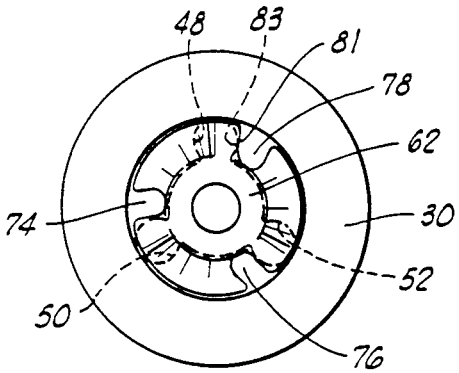
FIG. 7 illustrates a discharge end view of the inner disc in an operating position in the outer disc.

Referring now to FIGS. 1 and 7, when inner disc 62 is in an initial operating position, left edge 81 of notch 78 in inner disc 62 is substantially aligned with at least a portion of right edge 83 of notch 48 in outer disc 30. Corresponding edges of notches 74 and 50 are aligned, and corresponding edges of notches 76 and 52 are also aligned.

It will be seen that in this initial operating position, each of second ramps 82 on lugs 68, 70 and 72 of inner disc 62 are aligned with and generally face one of first ramps 54, 56 and 58 in outer disc 30. Flat portion 80 of each of lugs 68, 70 and 72 contacts inner edge 45 of first bore 44 in outer disc 30. In this way, it will be seen that a spiralling gap or fluid flow orifice 84 is defined between first ramp 54 and second ramp 82 of first lug 68. It will be seen by those skilled in the art that this gap 84 is in communication with notches 50 and 74. Similar gaps or orifices are defined between ramps 82 on each lug 70 and 72 and adjacent ramps 56 and 58, respectively.

Referring again to FIGS. 1 and 2, a bolt 86 is disposed through bore 66 in inner disc 62 with the head of bolt 86 preferably engaging axially outer end 67 of the inner disc. A biasing means, such as compression spring 88, is disposed around bolt 86 and a portion of central portion 64 of inner disc 62. One end of spring 88 engages rear face 36 of outer disc 30, and the other end of the spring engages a spring retainer 90 through which the shank of bolt 86 extends. A nut 92 holds spring retainer 90 and spring 88 in place. Thus, a fastening means is provided for fastening the biasing means to nozzle assembly 13. It will be seen that by adjusting nut 92, the initial force exerted by spring 88 may be adjusted, and thus it may be said that the fastening means comprises an adjusting means for adjusting the initial biasing force. Preferably, spring 88 is always in compression.

It will therefore be seen by those skilled in the art that outer disc 30, inner disc 62, spring 88, spring retainer 90, bolt 86 and nut 92 form a removable assembly which forms part of nozzle assembly 13 within burner nozzle 10.

Still referring to FIGS. 1 and 2, nozzle assembly 13 further comprises a burner nozzle insert 94 which is disposed in housing opening 18 of housing portion 14 adjacent to outer disc 30. Nozzle insert 94 may also be referred to as a swirl chamber 94. Insert 94 has a radially outwardly extending flange portion 96 which engages front face 40 of outer disc 30. Flange portion 96 has an outside diameter adapted to fit closely within second bore 22 of housing portion 14.

Extending axially outwardly from flange portion 96 of insert 94 is a substantially conical nozzle portion or tip 98. At least a portion of nozzle portion 98 has a substantially constant cross-sectional wall thickness. That is, nozzle portion 98 has a substantially conical inner surface 100 and a substantially conical outer surface 102. A longitudinally outer end 104 of insert 94 faces outwardly from burner nozzle 10.

Flange portion 96 of insert 94 has an outside diameter 106 adapted to fit closely within second bore 22 of housing portion 14. Flange portion 96 also defines an annular shoulder 108 thereon which faces toward the outlet of burner nozzle 10. It will be seen that shoulder 108 extends between outer surface 102 of nozzle portion 98 and outside diameter 106.

A nozzle retainer or nut 110, which may be said to be a part of nozzle assembly 13, is connected to housing portion 14 and has a threaded surface 112 which engages threaded surface 26 in housing portion 14. Nut 110 is adapted to bear against shoulder 108 on insert 94 to hold the insert in position, thus providing a fastening or retaining means radially outwardly of insert 94. Insert 94 bears against front face 40 of outer disc 30, and it will be seen that the outer disc is thus also held in position.

Nut 110 defines a substantially conical inner surface 114 therein which generally faces outer surface 102 of conical portion 98 of insert 94. Inner surface 114 in nut 110 is preferably spaced radially outwardly from outer surface 102 of insert 94 such that a generally annular, conical gap 116 is defined therebetween. This conical gap 116 allows for different thermal expansion of insert 94 in nut 110 and thereby prevents thermal ratcheting that might occur between the two components as a result of such expansion differences.

Nut 110 has a plurality of wrenching flats 118 thereon so that it may be easily threaded into housing portion 14. A longitudinally outwardly facing end 120 of nut 110 is preferably substantially flush with outer end 104 on insert 94.

Operation Of The Invention

After a fluid supply has been connected to fluid conduit means 12 and an air supply connected to any air jacket means that might be positioned around burner nozzle 10, fluid is flowed through fluid conduit means 12 toward nozzle assembly 13. That is, the fluid flows through housing opening 18 in housing portion 14 and into notches 48, 50 and 52 of outer disc 30. The fluid then flows into gaps or orifices 84 between the first and second ramps on outer disc 30 and inner disc 62. The fluid flows from gaps 84 into notches 74, 76 and 78 in inner disc 62 and then into insert 94.

As the fluid flows through spiral gaps 84, a swirling motion is imparted to the fluid which continues as the fluid flows through insert 94. Thus, insert 94 acts as a swirl chamber.

As previously discussed, inner disc 62 is held in its initial position axially with respect to outer disc 30 by spring 88. Fluid pressure in housing opening 18 of housing portion 14 forces inner disc 62 to move in an axially outward direction. This movement increases the size of spiral gaps 84 and compresses spring 88. Because gaps 84 increase in size, the velocity of the fluid flowing into insert 94 remains relatively high throughout a wide flow rate range. Thus, an adjustable orifice or nozzle means is provided which can accommodate relatively low fluid flow rates during start-up as well as higher fluid flow rates by increasing the orifice size.

It will be seen that, because of the conical shape of inner surface 100 of nozzle insert 94, movement of inner disc 62 in an axially outward direction is limited because the inner disc will eventually contact conical inner surface 100. Thus, a means is provided for limiting the maximum size of gaps or orifices 84. This also prevents inner disc 62 from being forced completely outwardly of nozzle insert 94 which would obviously essentially destroy the flow characteristics of burner nozzle 10 and could result in damage to spring 88 or other components.

As mentioned, the fluid has a swirling motion imparted thereto as it exits gaps 84 into insert 94. The swirling fluid is discharged from nozzle portion 98 of insert 94 adjacent to outer end 104 thereof and tends to spread to form a swirling, conical stream of fluid out of nozzle assembly 13. The high velocity of the fluid insures better atomization such that initial ignition occurs more quickly than with conventional nozzles. Quicker ignition results in less petroleum product fallout prior to combustion.

During well testing operations, as the fluid flow rate changes, the fluid velocity in insert 94 remains sufficiently high to produce good atomization over a wide range of flow rates for optimum burning. Therefore, for typical burners with multiple nozzles, manifolding is no longer necessary to turn the nozzles on and off to obtain optimum back pressure for good burning. Also, burners which are typically mounted on long booms do not require personnel going out to make adjustments to optimize the burn. This is an improvement from a safety as well as an operational standpoint.

It can be seen, therefore, that the burner nozzle of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A burner nozzle comprising:

a first disc defining a port therethrough and having a substantially helical first ramp thereon, an end of said ramp being in communication with said port;

a second disc adjacent to said first disc and having a substantially helical second ramp thereon, said first and second ramps generally facing one another and defining an orifice therebetween; and a swirl chamber adjacent to said first disc and adapted for directing fluid discharged from said orifice.

2. The nozzle of claim 1 wherein said swirl chamber has a substantially conical inner surface.

3. The apparatus of claim 1 further comprising biasing means for biasing said first and second discs toward one another.

4. The nozzle of claim 3 further comprising fastening means for fastening said biasing means to said second disc, said fastening means providing manual adjustment of an initial force exerted by said biasing means.

5. The nozzle of claim 1 further comprising a conduit defining an opening therethrough; and wherein:

said first disc is positioned against said conduit; and said port is in communication with said opening.

6. The nozzle of claim 1 further comprising a nozzle retainer engaged with said conduit for clamping said swirl chamber against said first disc and clamping said first disc against said conduit.

7. A burner nozzle comprising:

a fluid conduit;

an outer nozzle element adjacent to an end of said conduit, said outer nozzle element defining a central opening therethrough and a notch therein in communication with said conduit, said outer nozzle element further comprising a spiraling first ramp disposed radially outwardly of said central opening and extending from said port;

an inner nozzle element having a central portion extending into said central opening of said outer nozzle portion and having a spiraling second ramp thereon, said second ramp being adjacent to said first ramp and defining a variably open nozzle position wherein said second ramp is spaced from said first ramp;

biasing means for biasing said second ramp toward said first ramp;

a swirl chamber adjacent to said outer nozzle element; and retainer means for retaining said swirl chamber and outer nozzle element adjacent to said conduit;

wherein, fluid pressure in said conduit provides a force tending to move said inner nozzle element such that said second ramp is moved away from said first ramp.

8. The nozzle of claim 7 wherein said swirl chamber has a substantially conical inner surface.

9. The nozzle of claim 7 wherein said biasing means is characterized by a spring having an end engaging said outer nozzle element, said nozzle further comprising:

a spring retainer engaging an opposite end of said spring;

a bolt extending through said central portion of said inner nozzle element, said spring retainer and said spring; and a nut engaging an end of said bolt.

10. The nozzle of claim 7 wherein:

said port and said first ramp in said outer nozzle element are one of a plurality of such ports and first ramps angularly spaced around said central opening; and said second ramp on said inner nozzle element is one of a plurality of such second ramps angularly spaced around said central portion.

11. A petroleum apparatus comprising:

conduit means for connecting to a fluid source; and a nozzle attached to an end of said conduit means and defining a fluid stream orifice therein in communication with said conduit means, said orifice being variable in size in response to fluid pressure in said conduit means, said nozzle comprising:

a outer portion defining a first ramped surface thereon; and an inner portion defining a second ramped surface thereon adjacent to said first ramped surface; wherein, said orifice is defined between said first and second ramped surfaces.

12. The apparatus of claim 11 wherein said ramped surfaces are disposed at an acute angle with respect to a longitudinal axis of said conduit means.

13. The apparatus of claim 11 wherein said ramped surfaces are substantially helical.

14. The apparatus of claim 11 further comprising biasing means for relatively biasing said first and second ramped surfaces towards one another.

15. The apparatus of claim 11 further comprising adjusting means for manually adjusting an initial force exerted by the biasing means.

16. The apparatus of claim 11 further comprising sealing means for sealing between said nozzle and said conduit means.

* * * * *